US005624844A

United States Patent [19]

Xu et al.

[11] Patent Number: 5,624,844

[45] Date of Patent: Apr. 29, 1997

[54] PROCESS FOR DEMETALIZING A FOSSIL FUEL

[75] Inventors: Guo-Wei Xu; Kenneth W. Mitchell; Daniel J. Monticello, all of The Woodlands, Tex.

[73] Assignee: Energy BioSystems Corporation, The Woodlands, Tex.

[21] Appl. No.: 460,116

[22] Filed: Jun. 2, 1995

[51] Int. Cl.[6] ..... C10G 27/12; C10G 32/00

[52] U.S. Cl. ..... 435/264; 435/281

[58] Field of Search ..... 435/262, 264, 435/281

[56] References Cited

U.S. PATENT DOCUMENTS

| | | | |
|---|---|---|---|
| 4,703,010 | 10/1987 | Yunker et al. | 435/173 |
| 4,918,018 | 4/1990 | Waskovsky | 435/252.1 |

OTHER PUBLICATIONS

Fedorak, P.M. et al., "Chloroperoxidase–mediated modification of petroporphyrins and asphaltenes," *Enzyme Microb. Technol.*, 15:429–437 (May 1993).

Lin, J.H.C. et al., "Regulation of Heme Oxygenase gene expression by cobalt in rat liver and kidney," *J. Biochem.*, 192:5–77–582 (1990).

Gassman, M. and P. Ramanujam, "Relation between enzymatic destruction of magnesium–porphrins and chloroplast development," *Regulation of Chloroplast Differentiation*, 115–123 (1986).

Yoshinaga, T. et al. "A comparative study of heme degradation by NADPH–Cytochrome c reductase alone and by the complete heme oxygenase system," *J. Biol. Chem.*, 257(13):7794–7802 (Jul. 1982).

Meijer, A.H. et al., "Isolation and characterization of cDNA clone from *Catharanthus roseus* encoding NADPH:Cytochrome c reductase, an enzyme essential for reactions catalyzed by cytochrome P–450 mono–oxtgenases in plants," *The Plant J.*, 4(1):47–60 (1993).

Frakman, Z. et al., "Nitrogen compounds in Athabasca Asphatene: The Vanadyl porphyrins," *AOSTRA J. Res.*, 4(3):171–179 (Summer 1991).

Muira, Y. et al., "(w–2) Hydroxylation of fatty acids by a soluble system from *Bacillus megaterium*," *J. Biol. Chem.*, 249(6):1880–1888 (Mar. 25, 1974).

Bonkovsky, H.L., "Purification and characterization of heme oxygenase from chick liver," *J. Biochem.*, 189:155–166 (1990).

Beale, S. et al., "Enzymatic Heme Oxygenase Activity in soluble extracts of the unicellular red alga, *Cyanidium caldarium*," *Arch. Biochem. Biophys.*, 235(2):371–381 (1981).

Montellano et al., "Cytochrome P–450 destruction and ferrochelatase inhibition," *Porphrins & Porphyrias*, 134:109–117 (1986).

(List continued on next page.)

*Primary Examiner*—Arthur L. Corbin

*Attorney, Agent, or Firm*—Hamilton, Brook, Smith & Reynolds, P.C.

[57] ABSTRACT

The invention relates to a method of removing metals from a fossil fuel comprising the steps of contacting the fossil fuel with an oxygenase which degrades porphyrin molecules under conditions suitable for the removal of the metals from the fossil fuel; and separating the metals from the fossil fuel. Preferred embodiments of the oxygenase include heme oxygenase and cytochrome C reductase, such as cytochrome C reductase from *Bacillus megaterium*, *Catharanthus roseuse*, *Escherichia coli*, animal cells, plant cells or yeast cells. The cytochrome C reductase can be contacted with the fossil fuel in an aqueous medium as a substantially cell-free preparation or cell preparation. In one embodiment of the invention, the metals are recovered from the resulting metal containing stream.

14 Claims, No Drawings

OTHER PUBLICATIONS

Rotenberg, M.O. and M.D. Maines, "Characterization of a cDNA–Encoding rabbit brain heme oxygenase–2 and identification of a conserved domain among mammalian heme oxygenase isozymes: possible heme binding site?" *Arch. Biochem. Biophys.,* 290(2):336–344 (1991).

Yoshida, et al., "Degradation of heme by a soluble peptide of heme oxygenase obtained from rat liver microsomes by mild trypsination."0 *J. Biochem.,* 199:729–733 (1991).

Porter, T.D. et al., "Expression of a functional 78,000 dalton mammalian flavoprotein, NADPH–Cytochrome P–450 Oxidoreductase, in *Escherichia coli,*" *Arch. Biochem. Biophys.,* 254(1):353–367 (Apr. 1987).

Yasukochi, et al., " Comparision of properties of detergent–solubilized NADPH–Cytochrome P–450 reductase from pig liver and kidney immunochemical, kinetic and reconstitutive properties," *Arch. Biochem. Biophys.,* 202(2):491–498 (Jul. 1980).

Wilks, A. et al., "Rat Liver Heme Oxygenase," *J. Biol. Chem.,* 268(30):22357–22362 (Oct. 25, 1993).

Shibahara, S. et al., "Functional analysis of cDNAs for two types of human heme oxygenase and evidence for their separate regulation," *J. Biochem.,* 113:214–218 (1993).

Fischer, C.W. et al., "High–level expression in *Escherichia coli* of enzymatically active fusion proteins containing the domains of mammalian cytochromes P450 and NADPH–P450 reductase flavoprotein," *Proc. Natl. Acad. Sci., USA,* 89:10817–10821 (Nov. 1992).

Tyrrell, R.M. et al. "The proximal promoter region of the human heme oxygenase gene contains elements involved in stimulation of transcriptional activity by a variety of agents including oxidants," *Carcinogenesis,* 14(4):761–765 (1993).

Palmer, C.N.A. et al., "Characterization of a cDNA encoding a human kidney, cytochrome P–450 4A fatty acid w–hydroxylase and the cognate enzyme expressed in *Escherichia coli,*" *Biochimica et Biophysica Acta,* 1172:161–166 (1993).

Ishikawa, K. et al., "Expression of rat heme oxygenase in *Escherichia coli* as catalytically active, full–length form that binds to bacterial membranes," *J. Biochem.,* 202:161–165 (1991).

PROCESS FOR DEMETALIZING A FOSSIL FUEL

BACKGROUND OF THE INVENTION

Most crude petroleum contains measurable quantities of metals that can be present in two forms, salts and an organometallic fraction, e.g., metalloporphyrins. The metallic salts usually occur as inorganic water-soluble forms and are easily removed with water phase. Among the organometallic compounds, vanadium and nickel containing compounds are the most prevalent and are found almost exclusively in the resin and asphaltene fraction of crude oil. Nickel and vanadyl porphyrins occur as high as 120 to 1500 ppm, respectively, in heavy oil (Speight, J. G. (Ed.), *Fuel Science and Technology Handbook*, pp. 82–83, Marcel Dekker, Inc., New York, N.Y. (1990)).

Metals in petroleum lead to two major problems for the industry. Combustion of these fuels leads to the formation of ash with high concentrations of the metal oxides, leading to undesirable waste disposal issues. When crude oil is refined, the metals stay with the residual fraction and are concentrated as other fractions are boiled off. The residual fraction is often subjected to catalytic cracking, a thermal process to decompose the large molecules in residual oil to smaller, lower boiling point molecules. During catalytic cracking, metals in the oil deposit on the cracking catalysts, resulting in poisoning of the catalysts and decreasing their selectivity and activity.

Although microorganisms have been shown to be associated with the degradation of metalloporphyrines (Fedorak, P. M. et al., *Enzyme Microb. Technol.* 15:429–437 (1993)), there is little clear evidence that demetalization of crude oil can be achieved by biotechnological approaches. Recently, Fedorak et al. (Fedorak, P. M. et al., *Enzyme Microb. Technol.* 15:429–437 (1993)) demonstrated that an extracellular enzyme, chloroperoxidase can modify the petroporphyrins and asphaltenes. Nickel octaethylporphyrin and vanadyl octaethylporphyrin were reduced 93 and 53%, respectively, from the asphaltene fraction. However, the system requires chloride and the resulting products are chlorinated. Chlorinated products which pose a substantial environmental impact on combustion from fuels demetalized with this enzyme-catalyzed reaction would be undesirable.

Therefore, it is desirable to develop a process which will remove metals from a fossil fuel without resulting in chlorinated by-products.

SUMMARY OF THE INVENTION

The invention relates to a method of removing metals from a fossil fuel comprising the steps of contacting the fossil fuel with a biocatalyst comprising an oxygenase which degrades porphyrin molecules under conditions suitable for the removal of the metals from the fossil fuel; and separating the metals from the fossil fuel. In a preferred embodiment, the reaction is conducted in the absence of chlorine or chloride. In contrast to peroxidases, such as chloroperoxidase, oxygenases can degrade porphyrin molecules without subjecting the hydrocarbon to chlorine or peroxide. Preferred embodiments of the biocatalyst include heme oxygenase and cytochrome C reductase, such as cytochrome C reductase from *Bacillus megaterium, Catharanthus roseuse, Escherichia coli,* animal cells, plant cells or yeast cells. The oxidoreductase can be contacted with the fossil fuel in an aqueous medium as a substantially cell-free preparation, cell extract or whole cell preparation. In one embodiment of the invention, the metals are recovered from the resulting metal containing stream.

DETAILED DESCRIPTION OF THE INVENTION

The invention is based upon the discovery that enzymes that degrade porphyrin molecules, particularly the metalloporphyrins, remove metals within a fossil fuel. The metals which can be removed by the claimed invention include organometallics. Organometallics include metalloporphyrins (e.g., etioporphyrins). The metals which can be removed by the present method include nickel, vanadium, cobalt, copper, iron, magnesium, and zinc.

Metal-containing fossil fuels include petroleum, petroleum distillate fractions, coal-derived liquid shale, oil, bitumens, gilsonite and tars and mixtures thereof, particularly petroleum and petroleum distillate fractions as well as synthetic fuels derived therefrom. Fossil fuels with a particularly high content of organometallics include Bosean, Cerro Negro, Mayan, Wilmington and Prudhoe Bay Crude oils (see, e.g., Fish et al., *Anal. Chem.* 56:2452–2460 (1984)).

The biocatalyst of the claimed invention includes an enzyme or enzymes capable of the demetalization reaction and/or any active fragment of the enzyme or enzymes.

The biocatalysts which can be used in the disclosed method degrade porphyrin molecules, thereby releasing the metals and, preferably, retaining at least a majority of the carbon structure of the remaining portion of the ring system. Examples of the biocatalyst include heme oxygenase (EC 1.14.99.3) and cytochrome C reductase, such as cytochrome C reductase (EC 1.6.99.3) from *Bacillus megaterium, Catharanthus roseuse, Escherichia coli,* animal cells (such as liver or kidney cells), plant cells (such as from mung beans or *Arabidopsis thaliana*) or yeast cells (such as, *Candida tropiculis*).

In general, enzymes are protein catalysts made by living cells. Enzymes promote, direct, or facilitate the occurrence of a specific chemical reaction or series of reactions, which is referred to as a pathway, without themselves becoming consumed as a result thereof. Enzymes can include one or more unmodified or post-translationally or synthetically modified polypeptide chains or fragments or portions thereof with or without any coenzymes, cofactors, or coreactants which collectively carry out the desired reaction or series of reactions. Biocatalysts that are useful in the present invention include microbial lysates, extracts, fractions, subfractions, or purified products comprising the enzyme or enzymes capable of carrying out the desired biocatalytic function.

Where the biocatalyst is an enzyme, it can be recombinant or non-recombinant and can be added as a substantially cell-free, cell extract or whole cell preparation. Where the biocatalyst is a whole cell preparation, such as a non-human organism (for example, a bacteria, plant, yeast or animal cell or tissue culture) the cells can be viable or non-viable.

Nutrients and other additives which may additionally be added include coenzymes, cofactors, or coreactants of the cells or enzymes. For example, NADPH is beneficially added to a process employing cytochrome C reductase from *Bacillus megaterium* or *Catharanthus roseuse*.

In one embodiment, the biocatalyst is immobilized, facilitating recovery of the biocatalyst. For example, a non-viable microorganism can serve as the carrier for the biocatalyst. Other types of carriers which can be used include a membrane, filter, polymeric resin, diatomaceous material, glass particles or beads, ceramic particles beads or other supports.

The biocatalyst is preferably in an aqueous phase prior to contacting the biocatalyst with the fossil fuel. The aqueous phase can be water alone or in combination with one or more suitable solvents, including water miscible organic solvents. The choice of solvent is, generally, within the skill in the art.

The fossil fuel and aqueous phase containing the biocatalyst can be mixed to form a stable or unstable emulsion or microemulsion, with or without adjuvants or stabilizers, such as surfactants or dispersants.

The emulsion or microemulsion formed can be made according to methods known in the art. The continuous phase of the emulsion may be either the aqueous or organic phase, preferably the organic phase, minimizing the amount of water introduced into the reaction medium.

The reaction medium, such as the emulsion or microemulsion, is then maintained under conditions sufficient to bring about the demetalization of the organometallics.

For example, the reaction medium can be incubated under effective conditions for a sufficient period of time to produce an organic product, free metal and the biocatalyst. Preferably, the temperature is in the range of about 5° and 40° C. Preferably, the pH is between about 5 to about 9.

The reaction is allowed to proceed until a sufficient amount of the organometallics are converted. The metals are preferably removed or recovered from the resulting aqueous phase. For example, the metals formed can be readily removed by extraction (such as, a de-salt wash), distillation, ion exchange and/or column chromatography, for example.

The process can be conducted in a batch, semicontinuous or continuous mode alone or in combination with one or more additional biorefining processes (such as, a biodesulfurization process as described in U.S. Pat. No. 5,104,801, for example). Furthermore, the reaction can occur in a sealed or open vessel in the presence or absence of light.

The invention will now be described more specifically by the examples.

EXEMPLIFICATION

Chemicals

Flavin mononucleotide (FMN), flavin adenine dinucleotide (FAD), 3-[(3-cholamidopropyl) dimethyammonio)-1-propanesulfonate (CHAPS), cytochrome c, pyridine, and metal porpyhyrins including octaethyl porphyrin cobalt (II), octaethyl porphyrin copper (II), octaethyl porphyrin iron (III), octaethyl porphyrin magnesium (II), octaethyl porphyrin nickel (II), octaethyl porphyrin vanadium (IV), octaethyl porphyrin zinc (II) and chlorophyll a were purchased from Aldrich. Dithiothrietol (DTT), Hemin, nicotinamide adenine dinucleotide phosphate (NADPH), cytochrome C and phenylmethyl sulfonyl fluoride were obtained from Sigma. DE52 anion exchange resin, 2',5'-adenosine diphosphate-Sepharose 4 B, (2'5'ADP) and Sepharose 4 B were purchased from Pharmacia.

Sources of cytochrome c reductase

*Bacillus megaterium*, ATCC 14581 was used as the cytochrome c reductase-producing strain (Miura, Y. and Fulco, A. J. *J. Biol. Chem.* 249:1880–1888 (1974)). Plasmid pSK-R9 containing an insert of 2.3 kb cDNA fragment encoding for a partial NADPH-dependent cytochrome c reductase from *Catharanthus roseus* was obtained from Dr. A. Meijer (Meijer, A. H. et al., *Pl. J.* 4:47–60 (1993)). The plasmid was electroporated into and mantained in *E. coli* DH 10 β according to Sambrook et al. (Sambrook, J. et al., *Molecular Cloning: a Laboratory Manual*, 2nd Ed., Cold Spring Harbor Laboratory, Cold Spring Harbor, N.Y. (1989)).

EXAMPLE 1

Preparation of crude cytochrome c reductase

The *B. megaterium* was grown to late-log phase in a minimal medium (Vidaver, A. K., *Appl. Microbiol.* 15:1523–1524 (1967)) containing casamino acid (0.4%) at 30° C. with constant agitation overnight. The *E. coli* harboring pSK-R9 was cultured in LB broth (Sambrook, J. et al., *Molecular Cloning: a Laboratory Manual*, 2nd Ed., Cold Spring Harbor Laboratory, Cold Spring Harbor, N.Y. (1989)) to an O.D. of 0.2. IPTG was then added to the culture (final concentration, 2 mM) which was incubated at 37° C. with shaking for an additional 4 hours as described by Meijer et al., *Pl. J.* 4:47–60 (1993). Bacterial cells (Bacillus or *E. coli*) were harvested by centrifugation at 4,000 xg for 5 minutes and the pellets were resuspended into 1/10 of the original volume of 50 mM Tris buffer (pH 7.8) containing 1 mM EDTA, 5 mM DTT and 20% (v/v) glycerol. The bacterial suspensions were sonicated on ice for five periods of 30 seconds with 30 second intervals. Bacterial cell debris were removed by centrifugation at 38,000 xg for 40 minutes, and the supernatants were aliquoted into 100 μl volume and stored at −80° C. until assayed.

Protein concentration was determined by the method of Lowry et al., *J. Biol. Chem.* 193:265–275 (1951), using bovine serum albumin as a standard. Cytochrome c reductase concentration was estimated based on flavin content, using an extinction coefficient of 21.4 at 456 nm (Fisher, C. V. et al., *PNAS* 89:10817–10821 (1992)).

EXAMPLE 2

Purification of the cytochrome c reductase

One liter of minimal medium (in 3 1-liter flasks) was inoculated with *Bacillus megaterium* ATCC 14581 (using a 2% inoculum) from a fresh-growing culture and incubated at 30° C. with agitation for 12 hours. The cells were harvested by centrifugation at 5,000 rpm for 10 minutes at 4° C. and washed once with 0.25M sucrose solution. The pellet was resuspended in 30 ml of 75 mM sodium phosphate buffer, pH 7.5 containing 250 mM sucrose, 2.8 mM β-mercaptoethanol, 1 mM EDTA, 1 mM phenylmethylsulfonyl fluoride. Triton X-100 and CHAPS were added to final concentrations of 0.2 and 0.05%, respectively. The cell suspension was then passed through a French press at 10,000 $lb/in^2$. The mixture was set on ice for 1 hour and the cell debris was removed by centrifugation at 15,500 rpm for 20 minutes. The cytochrome c reductase was purified using a three-step purification procedure, namely, sepharose 4 B gel, DE52 ion-exchange and 2'5'ADP-sepharose affinity chromatography as described in (Sambrook, J. et al., *Molecular Cloning: a Laboratory Manual*, 2nd Ed., Cold Spring Harbor Laboratory, Cold Spring Harbor, N.Y. (1989)). The protein concentration was monitored at 280 nm with a Bio Rad Econo UV detector. Each fraction (0.75 ml) was collected and those containing proteins were assayed for the reductase activity.

EXAMPLE 3

Cytochrome c reductase assay

The cytochrome c reduction was determined according to a modification (Meijer, A. H. et al., *Pl. J.* 4:47–60 (1993)) of the method of Madyastha et al., (*Bio. Chem.* 15:1097–1102 (1976)). The assay mixture contained 100 μl of crude enzyme sonicated extract and 40 μM cytochrome c (type III, horse heart), 100 μM NADPH, in a final volume of 1 ml of 0.3M sodium phosphate buffer (pH 7.4). This mixture was incubated for 30 minutes at 37° C. with agitation in the dark. The degradation of cytochrome c was monitored at 550 nm and estimated using an extinction coefficient of 21 $mM^{-1}$ $cm^{-1}$.

EXAMPLE 4

Heme degradation by cytochrome c reductase

The Heme degradation activity of the cytochrome c reductase was determined as described by Yoshinaga et al. (Yoshinaga, T. et al., *J. Biol. Chem.* 257:7794–7802 (1982)). The reaction mixture contained 40 nM hemin, 800 nm of NADPH, and cytochrome c reductase (Example 1) in 0.1M potassium phosphate buffer, pH 7.5. Incubation was for 60 minutes at 37° C. with agitation in the dark. The reaction was stopped by adding 200 μl of pyridine and 50 μl of 8M KOH to form a pyridine hemochromogen (Paul, K. G. et al. *Acta Chem. Scand.* 7:1284–1287 (1953)). The amount of heme degraded was determined by the difference in absorbance between 540 and 557 nm of the pyridine hemochromogen and calculated using an extinction coefficient of 20.7 $mM^{-1}$ $cm^{-1}$.

The cytochrome c reductase derived from the crude extracts (*B. megaterium* and *E. coli*) constituted approximately 0.2% of the total cellular protein based on the measured flavin content. These crude extracts were initially tested for heme degradation. The cytochrome c reductase was capable of degrading at least 15 nm of hemin per hour under the conditions described above. The products derived from heme by the cytochrome c reductase extracts appear to be a mixture of either biliverdin isomers (Wilks, A. and de Montellano, P. R. O. *J. Biol. Chem.* 268:22357–22362 (1993)) or dipyrrolic propentdyopents. Biliverdin isomers α, and β have maximum wavelengths at 574 and 540 nm, respectively. The biliverdin isomers usually are associated with the production of bile pigment, whereas, propentdyopents obtained by cleavage of hemin with chytochrome c reductase are not associated with the pigment, which are the same as those derived from propentdyopents prepared by the cleavage of hemin with $H_2O_2$ according to Fischer and Mueller (French, J. S. and Coon, M. J., *Arch. Biochem. Biophys.* 195:565–577 (1979)).

EXAMPLE 5

Enzymatic characteristics of the cytochrome c reductase

To ensure the cytochrome c reductase activity and assess the purity of the eluate which contains cytochrome c reductase, partial purified cytochrome c reductase from the sepharose 4 B gel filtration alone or sepharose 4 B and DE52 ion-exchange chromatography (Example 2) was used for cytochrome c reduction assay. The cytochrome c reduction in the cell extracts was detected in the supernatant after 20 minutes of centrifugation at 30,000 xg. A portion of the activity was recovered from the protein fractions after gel filtration, DE52 ion-exchange and 2'5'-ADP affinity chromatography. The fractions 5–9 (from the eluate through sepharose 4 B gel filteration) showed higher activity of cytochrome c degradation, whereas, other fractions tested showed no detectable activity.

The fractions corresponding to the various cytochrome c reduction were electrophoresced on 10% SDS polyacrylamide gel and the gel was Coomassie stained. Three intensively stained bands (approximately 80–100 kDa) were revealed in several fractions, establishing higher activity. The protein of 80 kDa was most likely of the cytochrome c reductase.

EXAMPLE 6

Metal porphyrin degradation by the cytochrome c reductase

Three different reaction mixtures were tested to determine the optimum conditions for the demetalization study. Two mixtures, aqueous and ternary systems, were described by Fedorak et al. (Fedorak, P. M. et al. *Enzyme Microb. Technol.* 15:429–437 (1993), and contained KCl (9 mM) and phosphate buffer (3 mM, pH 3). A third ternary system contained phosphate buffer 100 mM, pH 7.1, and eliminated KCl. Metal porphyrins were dissolved in methylene chloride and distributed to 10 ml test tubes. After the methylene chloride was evaporated the reaction mixtures were added to the tubes. The reaction mixtures of total volume of 2 ml contained metal porphyrin (final concentration 17 μM) cytochrome c reductase (Example 1) and NADPH (final concentration of 400 nM). The mixtures were incubated for 60 minutes at 37° C. with agitation in the dark. Metal porphyrin degradation was determined spectrophotometrically by the disappearance at the Soret peak or by the difference of absorbance between 540 and 557 nm of the pyridine hemochromogen.

EXAMPLE 7

Nickel porphyrin degradation by the cytochrome c reductase

Nickel porphyrin was chosen as the model metalloporphyrin for demetalization. Different reaction mixtures were tested to determine the optimum conditions for demetalization. Two mixtures, aqueous and ternary systems, were described by Fedorak et al. ((Fedorak, P. M. et al. *Enzyme Microb. Technol.* 15:429–437 (1993)), and contained KCl (9 mM) and phosphate buffer (9 mM, pH 3). The third ternary system contained phosphate buffer at 100 mM, pH 7.1, and no KCl. Nickel porphyrins were dissolved in methylene chloride and distributed to 10 ml test tubes. After the methylene chloride was evaporated the reaction mixtures were added to the tubes. The reaction mixtures of total volume of 2 ml contained nickel porphyrin (final concentration 17 μM) cytochrome c reductase (Example 1) and NADPH (final concentration of 400 nM). The mixtures were incubated for 60 minutes at 37° C. with agitation in the dark. Degradation of nickel porphyrin in the two former systems was not significant since concentrations of the buffer and pH were too low. Treatment of nickel porphyrin in a modified solvent that contained toluene (11%), isopropanol (46%) and phosphate buffer (43%) resulted in a 50% reduction of the Soret peak at 392 nm. Two other peaks at 517 (β) and 552 nm (α) were reduced 10 and 40%, respectively. Using partially purified cytochrome c reductase (through sepharose 4 B gel filteration) the reduction of the nickel porphyrin was as high as 70%. The specific activity of the enzyme for nickel porphyrin degradation was approximately 0.4 μM per min per μg protein when cytochrome c reductase in the fraction 6 obtained from the sepharose 4 B gel filtration was used for assay.

The amount of degradation of nickel porphyrin was also determined by the difference in the absorbance between 557 and 540 nm since nickel porphyrin was similar to protoheme. Hemes, protoheme and mesoheme, can be measured by the height of the α peak above trough, lying between the α and β peaks, in the reduced minus oxidized pyridine hemochrome spectrum. Pyridine protohemochrome has the peak and trough at 557 and 540 nm, whereas, pyridine mesohemochrome has the peak and trough at 547 and 530 nm. In the same treatment the amount of nickel porphyrin degraded detected by measuring the reduction (disappearance) of the metal was similar to that obtained using pyridine hemochrome assay. A 59% of protoporphyrin (protoheme) reduction was derived based on the difference of spectrum between 557 and 540 nm, whereas, a 50% reduction of the metal was detected based on the reduction of the Soret peak.

EXAMPLE 8

Demetalization of metal porphyrins

Six other metal porphyrins, octaethyl porphyrin cobalt (II), octaethyl porphyrin copper (II), octaethyl porphyrin iron (III), octaethyl porphyrin magnesium (II), octaethyl porphyrin vadadium (IV) and octaethyl porphyrin zinc (II), and one chlorophyll (a) were also treated with the cytochrome c reductase alone and NADPH in the modified ternary system. Results of the metalloporphyrin degradation are summarized in Table 1. A considerable amount of these metalloporphyrins were degraded during a one-hour incubation period. Overally, between 3–37.2% reduction of the Soret peaks was achieved with the different metal porphyrins. A significant amount of the minor peaks (i.e., α and β) were also degraded (Table 1). For example, octaethyl porphyrin cobalt (II) resulted in three peaks, a Soret peak at 392 nm and two minor peaks (α at 552 and β at 517 nm). The octaethyl porphyrin cobalt (II) treated with the cytochrome c reductase resulted in reducing Soret peak by 29.3% and α peak by, whereas the β peak completely disappeared.

TABLE 1

Metal porphyrins degradation by the cytochromme c reductase.

| | % metal porphyrin degraded with cytochrome c reductase obtained from: | |
|---|---|---|
| Metal porphyrin | *Bacillus megaterium* ATCC 14581 | *Catharanthus roseus* |
| Etioporphyrin | | |
| Cobalt | 29.3 | 31.3 |
| Copper | 13.3 | 22.9 |
| Iron | 36.3 | N/A[a] |
| Magnesium | 6.5 | 5.0 |
| Nickel | 45.0 | 55.0 |
| Vanadium | 3.0 | 12.1 |
| Zinc | 28.1 | 39.5 |
| Deoxophylloerythroetioporphyrin | | |
| Chlorophyll a | 19.7 | 16.7 |

[a]N/A = not available

EXAMPLE 9

Demetalization of crude oil by cytochrome c reductase

Crude cytochrome c reductase was prepared from *B. megaterium,* ATCC 14581 was prepared as described above (Example 1). Activity was verified and protein concentration determined to be 8 mg/ml. NADPH and phosphate buffer (100 mM, pH 7.5) was added to the enzyme. Maya crude oil (AMOCO Research Center, Naperville, Ill.) was diluted to 50% by wt. with hexadecane. The reaction mixture, total volume of 10 ml, contained diluted crude oil (2.5 ml), phosphate buffer (up to 7.5 ml), 160 μg protein extract and NADPH (400 nM, final concentration). The mixture was incubated for 16 hours at 37° C. with agitation in the dark. Metal concentration differences were measured by XRF analysis. Concentration of organic sulfur was also monitored and served as an internal standard. Results of the demetalization are summarized in Table 2. A significant reduction of the nickel and vanadium (9.7% and 21.1%, respectively) was observed after treatment of the crude oil with cytochrome c reductase. Organic sulfur concentration remained substantially unchanged.

TABLE 2

Demetalization of Maya Crude Oil with NADPH-Dependent Cytochrome C Reductase

| Trial[a] | A | B |
|---|---|---|
| Sulfur (WT %) | 1.755[b] | 1.685 |
| V (ppm) | 59.06 | 46.57 |
| % reduced | — | 21.1 |
| Ni (ppm) | 6.82 | 6.16 |
| % reduced | — | 9.7 |

Equivalents

Those skilled in the art will recognize, or be able to ascertain using no more than routine experimentation, many equivalents to the specific embodiments of the invention described specifically herein. Such equivalents are intended to be encompassed in the scope of the claims.

We claim:

1. A method of removing metals from a fossil fuel comprising:

(a) contacting the fossil fuel with an oxygenase which degrades porphyrin molecules under conditions suitable for the removal of metals from the fossil fuel; and (b) separating the metals from the fossil fuel.

2. The method of claim 1 wherein the oxygenase is selected from the group consisting of heme oxygenase and cytochrome c reductase.

3. The method of claim 1 wherein the oxygenase is cytochrome c reductase.

4. The method of claim 3 wherein the source of the cytochrome C reductase is *Bacillus megaterium, Catharanthus roseuse, Escherichia coli,* animal cells, plant cells or yeast cells.

5. The method of claim 4 wherein the source of the cytochrome C reductase is liver or kidney cells.

6. The method of claim 4 wherein the source of the cytochrome C reductase is mung beans or *Arabidopsis thaliana.*

7. The method of claim 4 wherein the source of the cytochrome C reductase is *Candida tropiculis.*

8. The method of claim 4 wherein the cytochrome C reductase is recombinant.

9. The method of claim 4 wherein the cytochrome C reductase is a substantially cell-free preparation.

10. The method of claim 4 wherein the cytochrome C reductase is a cell preparation.

11. The method of claim 4 wherein the fossil fuel is petroleum or coal.

12. The method of claim 4 wherein the oxygenase is in an aqueous medium in step (a).

13. The method of claim 12 wherein the metals are separated in the aqueous medium.

14. The method of claim 13 further comprising the step of removing the metals from the aqueous medium.

* * * * *